US012515246B2

(12) United States Patent
Shiraishi et al.

(10) Patent No.: US 12,515,246 B2
(45) Date of Patent: Jan. 6, 2026

(54) MANUFACTURING METHOD FOR SLAB AND CONTINUOUS CASTING EQUIPMENT

(71) Applicant: NIPPON STEEL CORPORATION, Tokyo (JP)

(72) Inventors: Toshiyuki Shiraishi, Tokyo (JP); Daisuke Nikkuni, Tokyo (JP); Manabu Eto, Tokyo (JP); Masafumi Miyazaki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 531 days.

(21) Appl. No.: 16/976,388

(22) PCT Filed: Feb. 25, 2019

(86) PCT No.: PCT/JP2019/007014
§ 371 (c)(1),
(2) Date: Aug. 27, 2020

(87) PCT Pub. No.: WO2019/167868
PCT Pub. Date: Sep. 6, 2019

(65) Prior Publication Data

US 2020/0406321 A1 Dec. 31, 2020

(30) Foreign Application Priority Data

Mar. 2, 2018 (JP) ..... 2018-037945

(51) Int. Cl.
*B22D 11/055* (2006.01)
*B21B 1/02* (2006.01)
*B21B 45/02* (2006.01)

(52) U.S. Cl.
CPC ..... *B21B 1/02* (2013.01); *B21B 45/0251* (2013.01); *B22D 11/055* (2013.01); *B21B 2001/028* (2013.01)

(58) Field of Classification Search
CPC . B22D 11/06; B22D 11/0622; B22D 11/0648; B22D 11/0651; B22D 11/0665; B22D 11/0674
See application file for complete search history.

(56) References Cited

U.S. PATENT DOCUMENTS 4,056,140 A * 11/1977 Ives ..... B22D 11/1282 164/154.8
6,739,383 B1 5/2004 Marchionni et al.
(Continued)

FOREIGN PATENT DOCUMENTS

EP 1634657 B1 2/2012
JP 5-285601 A 11/1993
(Continued)

OTHER PUBLICATIONS

The Iron and Steel Institute of Japan, Theory and practice of strip rolling, Published by the Iron and Steel Institute of Japan, 1984, pp. 22-23, 195-197.

*Primary Examiner* — Keith Walker
*Assistant Examiner* — Steven S Ha
(74) *Attorney, Agent, or Firm* — Birch, Stewart, Kolasch & Birch, LLP

(57) ABSTRACT

This manufacturing method for a slab is a method for manufacturing a slab by a continuous casting equipment including a twin-drum type continuous casting apparatus, a cooling apparatus, an in-line mill, and a coiling apparatus. The method includes calculating a friction coefficient from measured values of a rolling load and a forward slip when the slab is rolled, by use of a rolling analysis model, and controlling a lubrication condition during rolling of the slab so that the friction coefficient falls within a predetermined range, wherein, when the friction coefficient is calculated from the measured values of the rolling load and the forward slip by use of an Orowan theory and a deformation resis-
(Continued)

tance model formula based on a Shida's approximate formula as the rolling analysis model, the predetermined range is 0.15 or more and 0.25 or less.

8 Claims, 6 Drawing Sheets

(56) References Cited

U.S. PATENT DOCUMENTS

| | | | | |
|---|---|---|---|---|
| 2002/0166653 | A1* | 11/2002 | Yamamura | B22D 11/0611 164/428 |
| 2008/0190162 | A1* | 8/2008 | Takahama | B21B 45/0266 148/650 |
| 2014/0373981 | A1* | 12/2014 | Wang | C22C 38/42 148/541 |

FOREIGN PATENT DOCUMENTS

| | | | |
|---|---|---|---|
| JP | 2000-343103 | A | 12/2000 |
| JP | 2000-343183 | A | 12/2000 |
| JP | 4454868 | B2 | 4/2010 |
| JP | 2017-094340 | A | 6/2017 |

* cited by examiner

FIG. 5

| | CONDITION 1 | | CONDITION 2 | | CONDITION 3 | | CONDITION 4 | | CONDITION 5 | |
|---|---|---|---|---|---|---|---|---|---|---|
| FRICTION COEFFICIENT | A=1mm,B=50 μm | | A=1mm,B=200 μm | | A=2mm,B=130 μm | | A=3mm,B=50 μm | | A=3mm,B=200 μm | |
| μ | EVALUATION | NOTE | EVALUATION | NOTE | EVALUATION | NOTE | EVALUATION | NOTE | EVALUATION | NOTE |
| 0.10 | × | SLIP | × | SLIP | × | SLIP | × | SLIP | × | SLIP |
| 0.12 | × | SLIP | × | SLIP | × | SLIP | × | SLIP | × | SLIP |
| 0.14 | × | SLIP | × | SLIP | × | SLIP | × | SLIP | × | SLIP |
| 0.15 | ○ | PROTRUSIONS DISAPPEARED | ○ | PROTRUSIONS DISAPPEARED | ○ | PROTRUSIONS DISAPPEARED | ○ | PROTRUSIONS DISAPPEARED | ○ | PROTRUSIONS DISAPPEARED |
| 0.17 | ○ | PROTRUSIONS DISAPPEARED | ○ | PROTRUSIONS DISAPPEARED | ○ | PROTRUSIONS DISAPPEARED | ○ | PROTRUSIONS DISAPPEARED | ○ | PROTRUSIONS DISAPPEARED |
| 0.19 | ○ | PROTRUSIONS DISAPPEARED | ○ | PROTRUSIONS DISAPPEARED | ○ | PROTRUSIONS DISAPPEARED | ○ | PROTRUSIONS DISAPPEARED | ○ | PROTRUSIONS DISAPPEARED |
| 0.21 | ○ | PROTRUSIONS DISAPPEARED | ○ | PROTRUSIONS DISAPPEARED | ○ | PROTRUSIONS DISAPPEARED | ○ | PROTRUSIONS DISAPPEARED | ○ | PROTRUSIONS DISAPPEARED |
| 0.23 | ○ | PROTRUSIONS DISAPPEARED | ○ | PROTRUSIONS DISAPPEARED | ○ | PROTRUSIONS DISAPPEARED | ○ | PROTRUSIONS DISAPPEARED | ○ | PROTRUSIONS DISAPPEARED |
| 0.25 | ○ | PROTRUSIONS DISAPPEARED | ○ | PROTRUSIONS DISAPPEARED | ○ | PROTRUSIONS DISAPPEARED | ○ | PROTRUSIONS DISAPPEARED | ○ | PROTRUSIONS DISAPPEARED |
| 0.27 | × | FOLDING | × | FOLDING | × | FOLDING | × | FOLDING | × | FOLDING |
| 0.29 | × | FOLDING | × | FOLDING | × | FOLDING | × | FOLDING | × | FOLDING |
| 0.31 | × | FOLDING | × | FOLDING | × | FOLDING | × | FOLDING | × | FOLDING |
| 0.33 | × | FOLDING | × | FOLDING | × | FOLDING | × | FOLDING | × | FOLDING |

MANUFACTURING METHOD FOR SLAB AND CONTINUOUS CASTING EQUIPMENT

TECHNICAL FIELD OF THE INVENTION

The present invention relates to a manufacturing method for a slab and a continuous casting equipment.

The present application claims priority based on Japanese Patent Application No. 2018-037945 filed in Japan on Mar. 2, 2018, and the content thereof is incorporated herein.

RELATED ART

In a twin-drum type continuous casting apparatus, a pair of continuous casting cooling drums (hereinafter referred to as "cooling drums") that are horizontally opposed to each other and a pair of side weirs form a molten metal storage portion, the pair of cooling drums is rotated, and thus a thin slab (hereinafter referred to as a "slab") is cast from molten metal stored in the molten metal storage portion (for example, Patent Document 1). When the molten metal is stored in the molten metal storage portion, the cooling drums are rotated in opposite directions, and the molten metal is sent downward as a slab while solidified and grown on peripheral surfaces of the cooling drums. The slab sent out from the cooling drums is sent out horizontally by pinch rolls and adjusted to a desired plate thickness by an in-line mill downstream. The slab whose plate thickness is adjusted by the in-line mill is coiled into a coil by a coiling apparatus installed downstream of the in-line mill.

In such a twin-drum type continuous casting apparatus, each of the cooling drums is generally at a low temperature before the start of casting, and when the casting is started, the temperature rises due to contact with the molten metal. In addition, the cooling drum is cooled from an inner surface by a cooling medium (for example, cooling water) so that the temperature does not become a predetermined temperature or higher. Hereinafter, a period in which the temperature of the cooling drum has reached a predetermined temperature and becomes constant is a steady casting period, any point in the steady casting period is a steady casting time, and the temperature of the cooling drum during the steady casting period is a steady temperature. In addition, a state during the steady casting period is referred to as a steady state.

A profile of the cooling drum changes with time from the start of casting to the steady state. Therefore, the profile of the cooling drum is set so that a plate profile (plate crown) of the slab at the steady casting time is a desired plate profile.

Furthermore, in such a twin-drum type continuous casting apparatus, a dummy sheet is used at the start of casting. A tip of the dummy sheet is set on a coiler, and a tail of the dummy sheet is set so as to be sandwiched by twin roll drums.

The molten metal to be a tip of the slab first cools and solidifies, and joins with the tail of the dummy sheet described above. After that, the cooling drum rotates and the slab is sequentially supplied to a casting coil. A plate thickness of a joint portion of the dummy sheet is much thicker than a plate thickness of the slab. This thick part is also referred to as a hump. If the hump is pressed or rolled hard with the pinch rolls or the in-line mill, meandering or plate breakage occurs, and thus this part is passed through the pinch rolls and the in-line mill with a compressive force not applied to the hump while a gap between upper and lower pinch rolls and a gap of work rolls (roll gap) of the in-line mill are wide-open. A flying touch of the pinch rolls is started after the hump has been passed through the pinch rolls. The flying touch of the in-line mill depends on a shape control ability of the in-line mill. If the shape control ability of the in-line mill is insufficient, after the hump has passed through the in-line mill, the flying touch will start after the cooling drum reaches the steady state, and rolling is performed so that the plate thickness on the outlet side of the in-line mill is a target value. If the shape control ability of the in-line mill is sufficient, after the hump has passed through the in-line mill, the flying touch will start from a state before the cooling drum reaches the steady state, and rolling is performed so that the plate thickness on the outlet side of the in-line mill is the target value.

For the purpose of improving cooling efficiency or casting stability, for example, a dimple process of forming concave shapes on a surface of the cooling drum is applied on the surface of the cooling drum of such a twin-drum type continuous casting apparatus, as described in Patent Document 2. Since the molten metal enters dimples and solidifies, protrusions formed by the dimples (hereinafter simply referred to as "protrusions" in some cases) are formed on the surface of the slab after the cooling drum. The shape of the protrusion may be determined by giving priority to the casting stability, as described in Patent Document 3.

When a slab having such protrusions is rolled with the in-line mill, folding of a protrusion may occur. Generally, the larger a ratio of the height of a protrusion to the width of the protrusion (height of protrusion/width of protrusion) and the larger a rolling reduction of the in-line mill, the more likely folding of the protrusion is to occur. Here, with reference to FIG. 1, a protrusion d1 in which folding occurs and a protrusion d10 in which folding does not occur will be described. FIG. 1 is a conceptual diagram illustrating folding of a protrusion formed on a slab. In FIG. 1, two protrusions d1 and d10 having different ratios of a protrusion height b to a protrusion width a are illustrated. The ratio of the height b to the width a of the protrusion d1 is larger than the ratio of the height b to the width a of the protrusion d10.

The protrusion d1 having a large ratio of the height b to the width a is easily folded when the slab is rolled with the in-line mill. An oxide scale c1 on a surface of the slab may be caught in a folded portion e where the protrusion d1 is folded. On the other hand, the protrusion d10 having a small ratio of the height b to the width a is hardly folded even when rolling is performed with the in-line mill. Therefore, unlike the protrusion d1, the folded portion e is not generated in the slab, and the oxide scale c1 on the surface of the slab is not caught.

The oxide scale on the surface of the slab is removed in a pickling step, which is the next step. However, the oxide scale c1 that has been caught in the folded portion e of the slab cannot be sufficiently removed by normal pickling. For this reason, when the slab is rolled to a thinner predetermined plate thickness after the pickling step, the oxide scale is exposed on the surface of the slab, a surface quality of the slab deteriorates, and a surface defect of the slab after rolling is apparent in some cases.

In order to dissolve the folded portion e of the protrusion by pickling for removing the oxide scale that has been caught in the folded portions e of the slab, a pickling time that is equal to or longer than twice as long as a normal time is required. Assuming that the folded portion with a depth equivalent to the thickness of the oxide scale is generated, a pickling ability is half or less even if simply considered. Therefore, productivity is significantly decreased. In addition, in the slab with a scale before pickling attached, it is difficult to judge whether or not the oxide scale has been caught due to folding of the protrusion, and in order to make a judgment, it is necessary to cut out the slab separately to create an observation sample and observe a cross section. Therefore, in the pickling step, from a viewpoint of quality assurance, a method of performing overmelting on the slab has been taken in order to reliably remove the oxide scale.

CITATION LIST

Patent Document

Patent Document 1: Japanese Unexamined Patent Application, First Publication No. 2000-343103

Patent Document 2: Japanese Unexamined Patent Application, First Publication No. H5-285601

Patent Document 3: Japanese Patent Publication No. 4454868

Non-Patent Document

Non-Patent Document 1: The Iron and Steel Institute of Japan, "Theory and Practice of Plate Rolling", published by The Iron and Steel Institute of Japan, 1984, pp. 22-23, p. 195,

SUMMARY OF INVENTION

Problems to be Solved by the Invention

However, if overmelting is performed to prevent a surface defect of the slab, deterioration of quality can be prevented, but increase in a manufacturing cost and decrease in a yield have been caused.

Therefore, the present invention has been made in view of the above problems, and an object of the present invention is to provide a manufacturing method for a slab and a continuous casting equipment capable of preventing, without impairing productivity, folding of a protrusion that occurs when a slab having protrusions formed by a twin-drum type continuous casting apparatus is rolled with an in-line mill.

Means for Solving the Problem (1) A first aspect of the present invention is a manufacturing method for a slab by a continuous casting equipment including a twin-drum type continuous casting apparatus in which a pair of cooling drums having dimples formed on surfaces of the cooling drums and a pair of side weirs form a molten metal storage portion, and that casts a slab having protrusions formed by the dimples from molten metal stored in the molten metal storage portion while the pair of cooling drums are rotated, a cooling apparatus that is arranged on a downstream side of the twin-drum type continuous casting apparatus and cools the slab, an in-line mill that is arranged on a downstream side of the cooling apparatus and performs one-pass rolling on the slab with a work roll at a rolling reduction of 10% or larger, and a coiling apparatus that is arranged on a downstream side of the in-line mill and coils the slab into a coil, the manufacturing method including calculating a friction coefficient from measured values of a rolling load and a forward slip when the slab is rolled by use of a rolling analysis model, and controlling a lubrication condition during rolling of the slab so that the friction coefficient falls within a predetermined range, wherein, when the friction coefficient is calculated from the measured values of the rolling load and the forward slip by use of an Orowan theory and a deformation resistance model formula based on a Shida's approximate formula as the rolling analysis model, the predetermined range is 0.15 or more and 0.25 or less.

(2) In the manufacturing method for a slab according to (1), a height of each of the protrusions may be 50 μm or higher and 100 μm or lower.

(3) In the manufacturing method for a slab according to (1) or (2), the lubrication condition may be a supply amount of lubricating oil supplied to the work roll or the cast slab or combination thereof.

(4) A second aspect of the present invention is a continuous casting equipment including a twin-drum type continuous casting apparatus in which a pair of cooling drums having dimples formed on surfaces of the cooling drums and a pair of side weirs form a molten metal storage portion, and that casts a slab having protrusions formed by the dimples from molten metal stored in the molten metal storage portion while the pair of cooling drums are rotated, a cooling apparatus that is arranged on a downstream side of the twin-drum type continuous casting apparatus and cools the slab, an in-line mill that is arranged on a downstream side of the cooling apparatus and performs one-pass rolling on the slab with a work roll at a rolling reduction of 10% or larger, a coiling apparatus that is arranged on a downstream side of the in-line mill and coils the slab into a coil, a measurement apparatus that actually measures a rolling load and a forward slip of the slab rolled with the in-line mill, and a lubrication control apparatus that calculates a friction coefficient from measured values of the rolling load and the forward slip by use of a rolling analysis model, and controls a lubrication condition during rolling of the slab so that the friction coefficient falls within a predetermined range, wherein, when the friction coefficient is calculated from the measured values of the rolling load and the forward slip by use of an Orowan theory and a deformation resistance model formula based on a Shida's approximate formula as the rolling analysis model, the predetermined range is 0.15 or more and 0.25 or less.

(5) In the continuous casting equipment according to (4), a height of each of the protrusions may be 50 μm or higher and 100 μm or lower.

(6) In the continuous casting equipment according to (4) or (5), the lubrication control apparatus may include a friction coefficient adjuster that calculates a supply amount of lubricating oil required to control the friction coefficient and controls supply of the lubricating oil supplied to the in-line mill.

Effects of the Invention

According to the means described above, it is possible to prevent, without impairing productivity, folding of a protrusion that occurs when a slab having protrusions formed by a twin-drum type continuous casting apparatus is rolled with an in-line mill.

BRIEF DESCRIPTION OF THE DRAWINGS

FIG. 5 is a table illustrating relationships between friction coefficients and protrusions.

EMBODIMENT OF THE INVENTION

Figure 1:
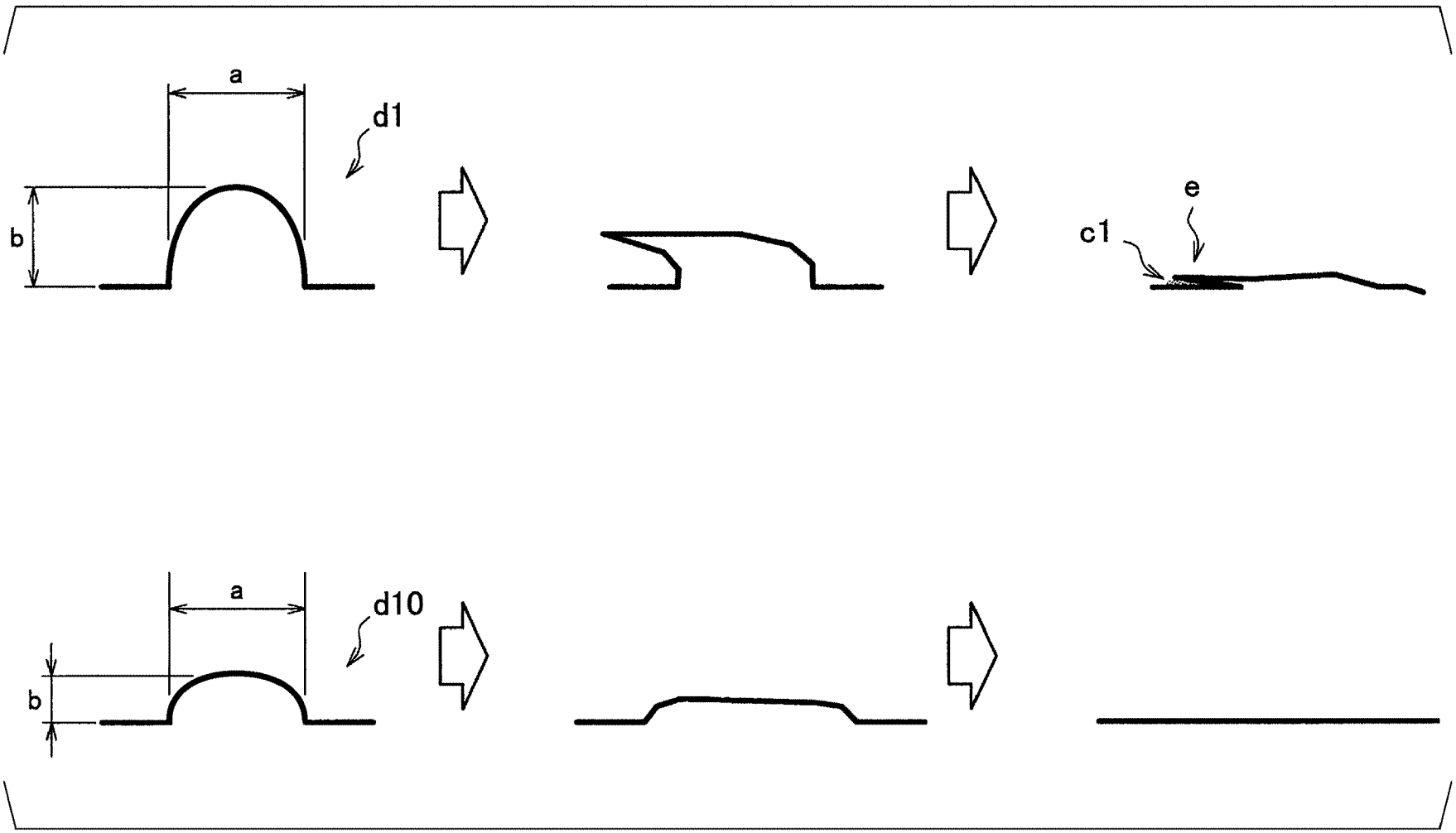
FIG. 1 is a conceptual diagram illustrating folding of a protrusion formed by a dimple.

A preferred embodiment of the present invention will be described in detail with reference to the drawings. In the present specification and the drawings, components having substantially the same functional configuration are designated by the same reference numerals, and thus a duplicate description will be omitted.

1. Outline

The present inventor has earnestly researched a manufacturing method for a slab capable of preventing folding of a protrusion when a slab manufactured by a twin-drum type continuous casting equipment and having protrusions formed by dimples is rolled with an in-line mill. As a result, the present inventor has conceived a method of calculating a friction coefficient from measured values of a rolling load and a forward slip by using a rolling analysis model when a slab is rolled with the in-line mill, and controlling a lubrication condition when the slab is rolled so that the friction coefficient falls within a predetermined range. By controlling the lubrication condition of the slab so that the friction coefficient falls within the predetermined range, it is possible to prevent folding of a protrusion formed on a surface of the slab without impairing productivity.

2. Manufacturing Steps

Figure 2:
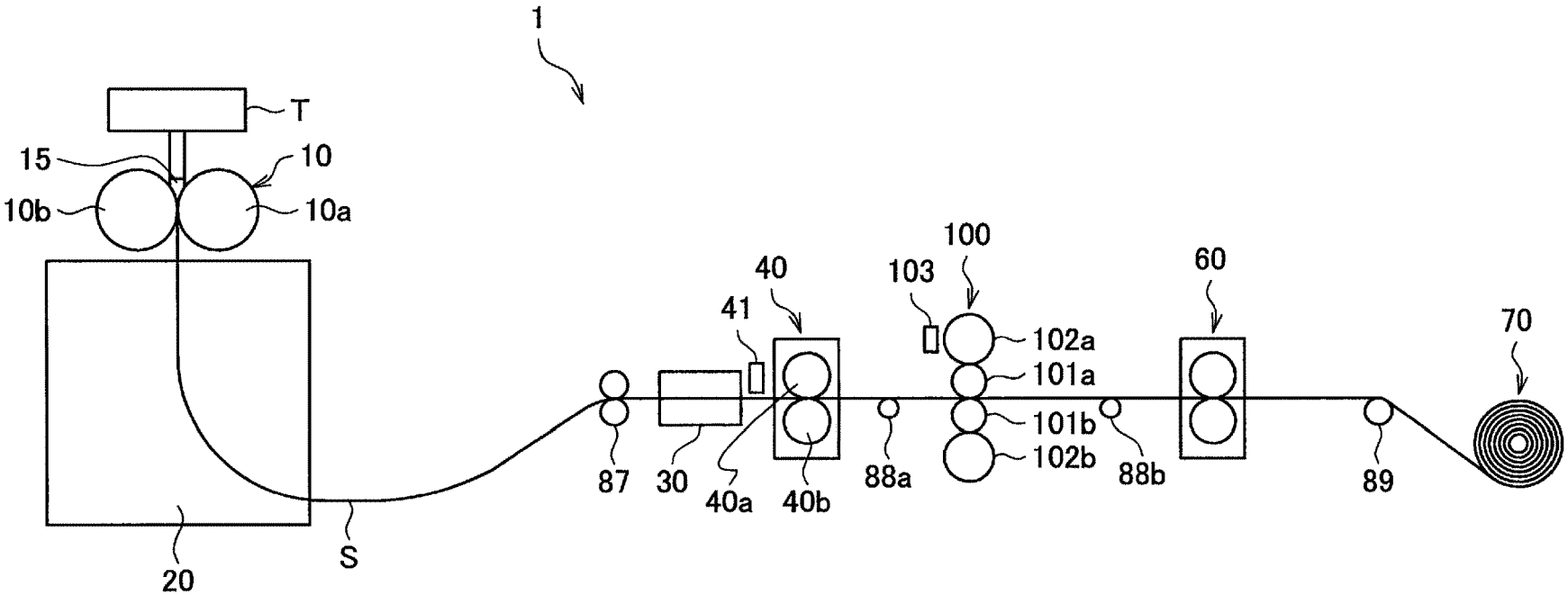
FIG. 2 is a diagram illustrating a twin-drum type continuous casting equipment according to an embodiment of the present invention.

First, with reference to FIG. 2, an outline of manufacturing steps for manufacturing a slab according to an embodiment of the present invention will be described. FIG. 2 is an explanatory diagram illustrating a schematic configuration of the manufacturing steps of a slab (thin slab) according to the present embodiment.

A continuous casting equipment 1 according to the present embodiment includes, as illustrated in FIG. 2, for example, a tundish (storage apparatus) T, a twin-drum type continuous casting apparatus 10, an oxidation prevention apparatus 20, a cooling apparatus 30, a first pinch roll apparatus 40, an in-line mill 100, a second pinch roll apparatus 60, and a coiling apparatus 70.

(Twin-Drum Type Continuous Casting Apparatus)

As illustrated in FIG. 2, the twin-drum type continuous casting apparatus 10 includes, for example, a pair of cooling drums 10*a* and 10*b*, and a pair of side weirs (not illustrated) arranged on both axial sides of the pair of cooling drums 10*a* and 10*b*. The pair of cooling drums 10*a* and 10*b* and the side weirs constitute a molten metal storage portion 15 that stores molten metal supplied from the tundish T. The twin-drum type continuous casting apparatus 10 casts a slab from the molten metal stored in the molten metal storage portion 15 while rotating the pair of cooling drums 10*a* and 10*b* in opposite directions.

The pair of cooling drums 10*a* and 10*b* includes a first cooling drum 10*a* and a second cooling drum 10*b*. Each of the first cooling drum 10*a* and the second cooling drum 10*b* has a concave shaped profile in which a center in an axial direction is slightly depressed. Furthermore, the first cooling drum 10*a* and the second cooling drum 10*b* are configured so that a gap between the cooling drums 10*a* and 10*b* can be adjusted in accordance with a plate thickness or an internal quality of a slab S to be manufactured. The first cooling drum 10*a* and the second cooling drum 10*b* are configured so that a cooling medium (for example, cooling water) can flow inside. By circulating the cooling medium inside the cooling drums 10*a* and 10*b*, it is possible to cool the cooling drums 10*a* and 10*b*. Furthermore, dimples are formed on surfaces of the cooling drums 10*a* and 10*b*.

In the present embodiment, the first cooling drum 10*a* and the second cooling drum 10*b* are set (initially processed) so that, for example, an outer diameter is 800 mm, a drum body length (width) is 1500 mm, a plate crown of the slab S in the steady state is 30 μm. In addition, each of the dimples may have a length in a rolling direction of 1.0 mm to 2.0 mm and a depth of 50 μm to 100 μm. That is, a length of a protrusion formed by the dimple in the rolling direction may be 1.0 mm to 2.0 mm, and a height of the protrusion formed by the dimple may be 50 μm or higher and 100 μm or lower. Note that the outer diameter, the drum body length (width), and the dimple shape of the pair of cooling drums 10*a* and 10*b* are not limited to these.

In the twin-drum type continuous casting apparatus 10, a dummy sheet (not illustrated) is connected to a tip of the slab S to start casting. A dummy bar (not illustrated) thicker than the slab S is provided at a tip of the dummy sheet, and the dummy sheet is guided by the dummy bar. In addition, a hump (not illustrated) thicker than the plate thickness of the slab S is formed at a connecting portion between the tip of the slab S and the dummy sheet. In rolling in the in-line mill 100, a rolling start method called flying touch is performed in which the rolling starts after the hump has passed through the in-line mill 100. By such a rolling start method, the slab S from a tip portion of the slab S to a flying touch start portion remains in a cast state.

(Oxidation Prevention Apparatus)

The oxidation prevention apparatus 20 is an apparatus that performs treatment for preventing a surface of the slab S immediately after casting from being oxidized to generate a scale. In the oxidation prevention apparatus 20, for example, an amount of oxygen can be adjusted by nitrogen gas. It is preferable to apply the oxidation prevention apparatus 20 as necessary in consideration of a steel type or the like of the slab S to be cast.

(Cooling Apparatus)

The cooling apparatus 30 is an apparatus that is arranged on the downstream side of the twin-drum type continuous casting apparatus 10 and cools the slab S whose surface has been subjected to antioxidant treatment by the oxidation prevention apparatus 20. The cooling apparatus 30 includes, for example, a plurality of spray nozzles (not illustrated) and sprays cooling water from the spray nozzles to surfaces (upper surface and lower surface) of the slab S in accordance with the steel type to cool the slab S.

Note that a pair of feed rolls 87 may be arranged between the oxidation prevention apparatus 20 and the cooling apparatus 30. The pair of feed rolls 87 does not roll the slab S but sandwiches the slab S with a pressing apparatus (not illustrated). The pair of feed rolls 87 applies a horizontal conveying force to the slab S so that a loop length of the slab S between the pair of cooling drums 10*a* and 10*b* and the feed rolls 87 is constant while measuring the loop length. The feed rolls 87 include, for example, a pair of rolls each having a roll diameter of 200 mm and a roll body length (width) of 2000 mm.

(First Pinch Roll Apparatus)

The first pinch roll apparatus 40 is a pinch roll apparatus arranged on the inlet side of the in-line mill 100. The first pinch roll apparatus 40 does not roll the slab S, and includes an upper pinch roll 40*a*, a lower pinch roll 40*b*, a housing, a roll chock, a rolling load detection apparatus, and a pressing apparatus (none are illustrated excluding the first pinch roll apparatus 40). The upper pinch roll 40*a* and the lower pinch roll 40*b* each has a hollow channel formed therein, and is configured to allow a cooling medium (for example, cooling water) to flow therethrough. By circulating the cooling medium, it is possible to cool the first pinch roll apparatus 40.

The upper pinch roll 40*a* and the lower pinch roll 40*b* may each have a roll diameter of 400 mm and a roll body length (width) of 2000 mm, for example. The upper pinch roll 40*a* and the lower pinch roll 40*b* are arranged via the roll chock in the housing, and are rotationally driven by a motor (not illustrated). In addition, the upper pinch roll 40*a* is coupled to a pass line adjustment apparatus (not illustrated) via an upper rolling load detection apparatus (not illustrated), and the lower pinch roll 40*b* is connected to the pressing apparatus (not illustrated).

In the first pinch roll apparatus 40 having such a configuration, when the lower pinch roll 40*b* is pushed up to the upper pinch roll 40*a* side by the pressing apparatus, a pressing load applied to the upper pinch roll 40*a* and the lower pinch roll 40*b* is detected, and tension is generated in the slab S between the first pinch roll apparatus 40 and the in-line mill 100. Furthermore, movement speed of the slab S in the pair of pinch rolls 40*a* and 40*b* and the in-line mill 100 is controlled so that the tension generated in the slab S between the first pinch roll apparatus 40 and the in-line mill 100 is preset tension. The tension of the slab S between the first pinch roll apparatus 40 and the in-line mill 100 is detected by a tension roll 88*a*. A position detection apparatus 41 that detects a position of the slab may be provided on the upstream side of the first pinch roll.

(In-Line Mill)

The in-line mill 100 is a rolling apparatus that is arranged on the downstream side of the cooling apparatus 30 and the first pinch roll apparatus 40 and performs one-pass rolling on the slab S to roll the slab S to a desired plate thickness. In the present embodiment, the in-line mill 100 is configured as a quadruple rolling mill. That is, the in-line mill 100 includes a pair of work rolls 101*a* and 101*b* and backup rolls 102*a* and 102*b* arranged above and below the work rolls 101*a* and 101*b*. Note that the "one-pass rolling" means plastically deforming, by one rolling with the in-line mill 100, the slab S having a plate thickness of the slab S that has passed through the continuous casting apparatus 10 so that the slab S has a desired plate thickness on the outlet side of the in-line mill.

The in-line mill 100 can roll the slab S to a desired plate thickness without impairing productivity, by performing one-pass rolling on the slab S at a rolling reduction of 10% or larger. The rolling reduction is preferably 15% or larger, and more preferably 20% or larger.

The upper limit of the rolling reduction is not particularly limited, but if the rolling reduction in one-pass rolling is excessively large, folding of a protrusion may occur even if a friction coefficient is controlled as described below. Therefore, the upper limit of the rolling reduction is preferably 40% or lower, and more preferably 35% or lower.

Note that the rolling reduction (r) is defined by the following formula.

$$r=\{(H-h)/H\}\times 100(\%)$$

Here, H (mm) is a plate thickness of the slab S before rolling, and h (mm) is a plate thickness of the slab S after rolling.

For the in-line mill 100, for example, the work rolls 101*a* and 101*b* each having a roll diameter of 400 mm and the backup rolls 102*a* and 102*b* each having a roll diameter of 1200 mm may be used. A body length of each roll may be the same, for example, 2000 mm.

In addition to the above-described configuration, the in-line mill 100 is additionally provided with equipment or the like for supplying lubricating oil to the work rolls or the slab or combination thereof, so that a lubrication condition and the like can be controlled. Detailed description regarding the supply of the lubricating oil will be described later.

(Second Pinch Roll Apparatus)

The second pinch roll apparatus 60 is arranged on the outlet side of the in-line mill 100. Similarly to the first pinch roll apparatus 40, the second pinch roll apparatus 60 does not roll the slab S, and includes an upper pinch roll, a lower pinch roll, a rolling load detection apparatus, and a pressing apparatus (none are illustrated excluding the second pinch roll 60). The upper pinch roll and the lower pinch roll each has a hollow channel formed therein, and is configured to allow a cooling medium (for example, cooling water) to flow therethrough. By circulating the cooling medium, it is possible to cool the pinch rolls. The upper pinch roll and the lower pinch roll may each have a roll diameter of 400 mm and a roll body length (width) of 2000 mm, for example. In addition, the upper pinch roll and the lower pinch roll are arranged via a roll chock in a housing, and are rotationally driven by a motor (not illustrated). A tension roll 88*b* is arranged between the in-line mill 100 and the second pinch roll apparatus 60.

(Coiling Apparatus)

The coiling apparatus 70 is an apparatus that is arranged on a downstream side of the in-line mill 100 and the second pinch roll apparatus 60 and coils the slab S into a coil. A deflector roll 89 is arranged between the second pinch roll apparatus 60 and the coiling apparatus 70.

3. Apparatus Configuration and Control of Lubrication Condition

When a slab having protrusions is rolled with the in-line mill, occurrence of folding of a protrusion leads to generation of a surface defect. Therefore, as a result of an examination to prevent the occurrence of folding of a protrusion, the inventor of the present application has known that the presence or absence of the occurrence of folding of a protrusion changes in accordance with a friction coefficient between the slab and the work rolls in the in-line mill. Based on such knowledge, the inventor of the present application has then conceived that the friction coefficient between the slab and the work rolls is controlled by control of a lubrication condition during rolling with the in-line mill, and the occurrence of folding of a protrusion is prevented. Hereinafter, the control of the lubrication condition for preventing the occurrence of folding of a protrusion of the slab by control of the lubrication condition during rolling of the slab with the in-line mill will be described in detail. Note that, here, as an example of the control of the lubrication condition, an example of controlling a supply amount of the lubricating oil will be described.

3-1. Detailed Configuration of In-Line Mill

Figure 3:
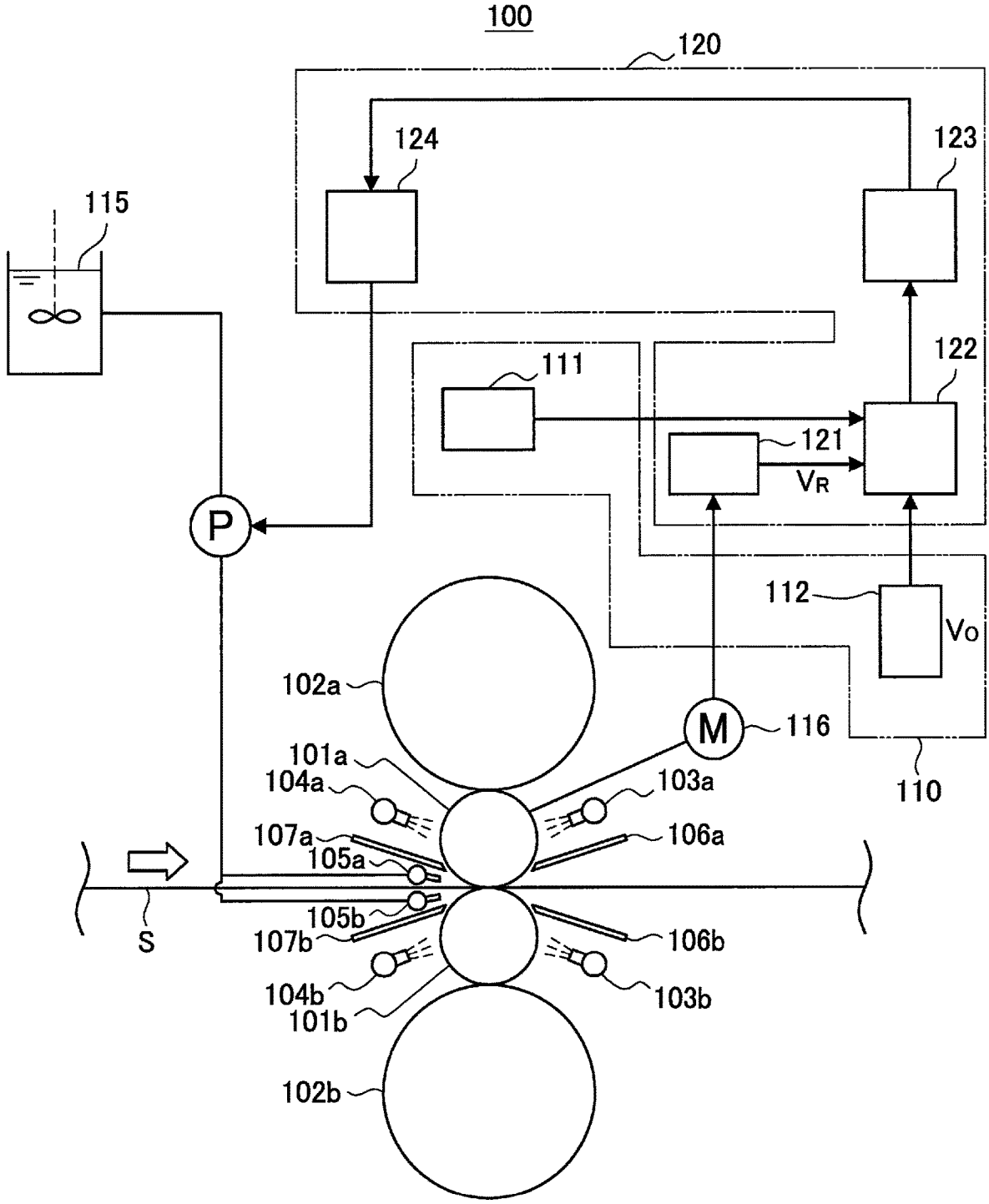
FIG. 3 is a detailed diagram of an in-line mill of the twin-drum type continuous casting equipment according to the same embodiment.

Before the control of the lubrication condition during rolling with the in-line mill 100 is described, details of the in-line mill 100 in the present embodiment will be described with reference to FIG. 3. FIG. 3 is a detailed diagram of the in-line mill 100.

The in-line mill 100 includes the pair of work rolls 101*a* and 101*b* and the backup rolls 102*a* and 102*b* arranged above and below the work rolls 101*a* and 101*b*.

Cooling water supply nozzles 103*a*, 103*b*, 104*a*, and 104*b* are provided in front and behind in the rolling direction of the in-line mill 100, and cooling water is supplied to the work rolls 101*a* and 101*b*. The work rolls 101*a* and 101*b* are cooled by the cooling water. Furthermore, draining plates 106*a*, 106*b*, 107*a*, and 107*b* are provided between the cooling water supply nozzles 103*a*, 103*b*, 104*a*, and 104*b* and the slab S so that the cooling water does not reach the slab.

Lubricating oil supply nozzles 105*a* and 105*b* that supply the lubricating oil to surfaces of the work rolls or the slab or combination thereof are installed between the draining plates 107*a* and 107*b* installed on the inlet side of the in-line mill 100 and the slab S. In the description of the present embodiment, the lubrication condition is controlled by control of the supply amount of the lubricating oil by the lubricating oil supply nozzles 105*a* and 105*b*.

The lubricating oil supplied from the lubricating oil supply nozzles 105*a* and 105*b* is stored in a lubricating oil tank 115. The lubricating oil may be, for example, emulsion lubricating oil produced by heating and stirring water and rolling lubricating oil mixed in the lubricating oil tank 115. The produced emulsion lubricating oil is sent by a pump P and is supplied from the lubricating oil supply nozzles 105*a* and 105*b* through a pipe.

Note that the lubricating oil may be only the rolling lubricating oil without including a diluent such as water. In addition, hot water and the rolling lubricating oil may be stored in separate tanks and separately supplied into the pipe from respective storage locations, and then both may be mixed and sheared to obtain the emulsion lubricating oil. As a method of supplying only the lubricating oil by the lubricating oil supply nozzles 105*a* and 105*b*, the lubricating oil itself may be sprayed onto the work rolls, such as air atomization. Moreover, solid lubricating oil may be supplied to the slab. When the supply amount of the lubricating oil supply nozzles 105*a* and 105*b* is changed to change the temperature of the slab on the inlet side of the rolling mill, the temperature of the slab may be controlled by cooling control of the cooling apparatus 30 so that the temperature of the slab on the inlet side of the rolling mill does not change even if the supply amount of the lubricating oil supply nozzles 105*a* and 105*b* is changed. Note that, in the present embodiment, the continuous casting equipment is shown in which the cooling water supply nozzles 104*a* and 104*b*, the draining plates 106*a* and 106*b*, the lubricating oil supply nozzles 105*a* and 105*b* are provided on the inlet side of the rolling mill, but the cooling water supply nozzles 104*a* and 104*b* and the draining plates 106*a* and 106*b* are not essential and may be omitted.

Here, in the case of controlling the lubrication condition by supplying the lubricating oil, it is necessary to measure various parameters during rolling to control the lubrication condition. Therefore, for example, a measurement apparatus 110 that measures information necessary for controlling the lubrication condition and a lubrication control apparatus 120 that controls the lubrication condition of the in-line mill 100 are provided.

The measurement apparatus 110 includes a load cell 111 and a plate speed meter 112. The measurement apparatus 110 actually measures various values necessary for controlling the lubrication condition. The load cell 111 is provided to a roll chock of the upper backup roll 102*a* and measures a rolling load. The plate speed meter 112 is provided on the outlet side of the rolling mill and measures a plate speed ($V_0$) of the slab. As the plate speed meter 112, for example, a non-contact type speed meter may be used.

The lubrication control apparatus 120 includes a work roll (WR) speed converter 121, a calculator 122, a friction coefficient calculator 123, and a friction coefficient adjuster 124. The lubrication control apparatus 120 calculates a friction coefficient μ based on values detected and calculated by the measurement apparatus 110 to control the lubrication condition. The WR speed converter 121 calculates a work roll speed ($V_R$) from a rotation number of a motor 116 using a ratio of a speed reducer (not illustrated) and a work roll diameter. The calculator 122 calculates a forward slip (fs) from the plate speed of the slab and the work roll speed. The calculator 122 calculates the forward slip (fs) from the following formula (1). That is, the calculator 122 calculates the forward slip (fs) based on the plate speed ($V_o$) and the work roll speed ($V_R$).

$$f_S=(V_O/V_R-1)\times 100 \quad (1)$$

The friction coefficient calculator 123 calculates the friction coefficient μ based on the forward slip (fs) calculated by the calculator 122 and the rolling load. The friction coefficient adjuster 124 then calculates a supply amount of the lubricating oil required to control the friction coefficient μ using the calculated friction coefficient μ. The friction coefficient adjuster 124 further controls the pump P so that the supply amount of the lubricating oil is the supply amount of the lubricating oil required to control the calculated friction coefficient μ to perform the supply control of the lubricating oil supplied to the in-line mill 100. As described above, the lubrication condition is controlled by use of the measurement apparatus 110 and the lubrication control apparatus 120.

3-2. Relationship Between Occurrence of Folding of Protrusion and Friction Coefficient When a slab having protrusions is rolled with the in-line mill 100 illustrated in FIG. 3, the lubrication condition during rolling with the in-line mill is controlled in order to roll the slab so that folding of a protrusion does not occur. In the present embodiment, the lubrication condition is controlled by control of the friction coefficient between the slab and the work rolls.

Folding of a protrusion is caused by deformation in a roll bite, which occurs during rolling of the slab, and is greatly affected by a shearing force of a surface layer in the roll bite. Here, the shearing force is calculated by multiplication of a compression stress (rolling load) in the roll bite by the friction coefficient μ. In an in-line mill that rolls a slab cast by a twin-drum type casting apparatus, basically, rolling is performed without changing the conditions such as a steel type, a rolling speed, and tension, and the same applies to a rolling reduction. Therefore, although values of these parameters cannot be changed, it is possible to change the shearing force of the surface layer in the roll bite in the in-line mill by adjusting the friction coefficient μ. Therefore, the inventor of the present application examined an appropriate range of the friction coefficient μ during rolling that can prevent folding of a protrusion of the slab.

Figure 4:
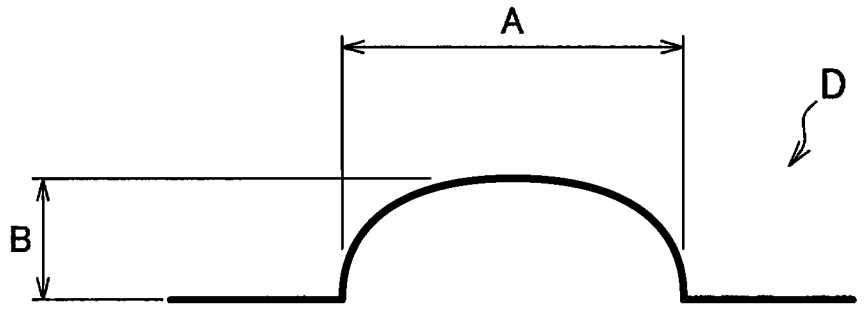
FIG. 4 is a schematic diagram of a protrusion formed by a dimple.

In defining the range of the friction coefficient in which folding of a protrusion of the slab does not occur, a width of the protrusion and a height of the protrusion were changed to verify a folding state of the protrusion of the slab after rolling. The results will be described with reference to FIGS. 4 and 5. In the present verification, as illustrated in FIG. 4, five shape conditions of the protrusion were set so that a width A of a protrusion D was changed to 1 to 3 mm and a height B of the protrusion D was changed to 50 to 200 μm. Then, each of slabs on which these protrusions were formed was rolled while the friction coefficient μ was changed between 0.10 and 0.33. The friction coefficient μ is a value calculated by use of a rolling analysis model based on the rolling conditions shown below. In the present verification, as the rolling analysis model, the Orowan theory and a deformation resistance model formula based on the Shida's approximate formula were used.

The rolling of the slab in the present verification was performed in manufacturing steps of a slab having a configuration similar to that in FIG. 2. The slab used had a plate thickness of 2 mm and a plate width of 1200 mm, and was ordinary steel. An acceleration rate of the cooling drum from the start of casting was 150 m/min/30 seconds, and a rotation speed of the cooling drum in the steady state was 150 m/min. Note that an initial profile of the cooling drum was processed so that a plate crown of the slab was 43 μm in the steady state. Note that the rolling of the slab in the present verification was performed by use of the ordinary steel, but the type of steel rolled is not limited to the ordinary steel.

Furthermore, in the in-line mill 100, one-pass rolling was performed on the slab with a plate temperature of 1000° C. at a rolling reduction of 30%, and the slab on the outlet side of the in-line mill had a plate thickness of 1.4 mm. The rolling with the in-line mill 100 was started after a dummy sheet passed through the in-line mill 100 and the plate crown of the slab became 150 μm or less. In the present verification, the rolling with the in-line mill 100 was started 15 seconds after the start of casting. As rolling lubricating oil, lubricating oil (melting point: 0° C.) based on a synthetic ester (hindered complex ester) was supplied by an air atomizing method.

FIG. 5 illustrates evaluation of steel plates under five conditions in which the width A and the height B of the protrusion are changed in the range of the friction coefficient of 0.10 to 0.33. In the evaluation, a steel plate that was unstable during rolling or on which folding of a protrusion occurred is indicated by x. Furthermore, a steel plate on which no rolling defect such as unstable rolling was confirmed, the protrusions disappeared, and there was no folding is indicated by ○.

With reference to the evaluation of FIG. 5, it was found that folding of the protrusion D occurred when the friction coefficient μ exceeded 0.25 regardless of the shape of the protrusion. When the friction coefficient μ was 0.15 or more and 0.25 or less, the protrusion D disappeared and folding did not occur even when the width A and the height B of the protrusion were in any shape in the conditions 1 to 5. When the friction coefficient μ was less than 0.15, the protrusions disappeared, but the friction coefficient was small and thus a slip occurred during rolling due to excessive lubrication, and the rolling became unstable. Note that the excessive lubrication may occur because the supply amount of the lubricating oil is unnecessarily large, and in this case, a basic unit of the lubricating oil is deteriorated and a manufacturing cost of the slabs is increased. In the range where the friction coefficient μ exceeded 0.25, folding of the protrusion D occurred. From these results, a specified range of the friction coefficient μ is 0.15 to 0.25.

As described above, in the in-line mill 100 according to the present embodiment, the specified range of the friction coefficient μ is set to 0.15 or more and 0.25 or less to control the lubrication condition during rolling, thereby preventing folding of a protrusion of the slab. Note that, in the conventional equipment, the lubricating oil is not supplied, and water lubrication that also functions as roll cooling has been performed. In the case of the water lubrication, the friction coefficient is high, and when the friction coefficient is calculated from measured values of a rolling load and a forward slip by use of the Orowan theory and the deformation resistance model formula based on the Shida's approximate formula as the rolling analysis model, the friction coefficient is in the range of about 0.3 to 0.4.

3-3. Method for Controlling Lubrication Condition

Figure 6:
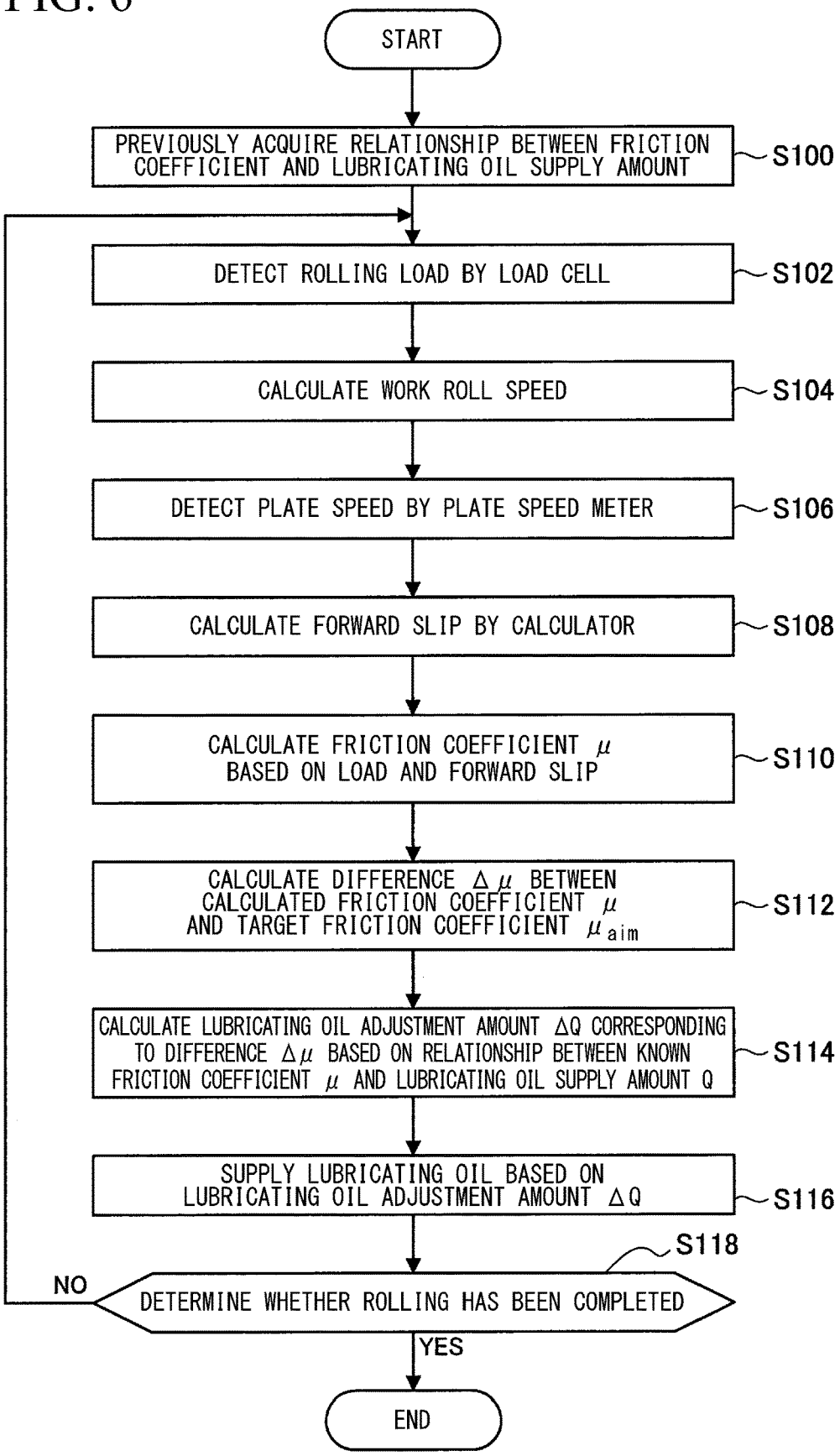
FIG. 6 is a flowchart illustrating an example of a control flow of a lubrication condition.

Hereinafter, based on FIG. 6, a method for controlling the lubrication condition so that the friction coefficient μ in the in-line mill 100 falls within the specified range will be described. FIG. 6 is a flowchart illustrating a method for controlling the lubrication condition according to the present embodiment.

[S100: Pre-Process]

When a lubricating oil supply amount to the work rolls is controlled as the lubrication condition so that the friction coefficient falls within the specified range, first, in a target equipment, that is, the in-line mill 100 illustrated in FIG. 3, the lubricating oil supply amount is changed in the steady state to previously acquire a relationship between the lubricating oil supply amount and the friction coefficient μ (S100).

(Method for Calculating Friction Coefficient)

Here, first, a method for calculating the friction coefficient will be described. The friction coefficient μ can be calculated by use of a rolling analysis model. A value of the friction coefficient μ is slightly different depending on the rolling analysis model to be used. Here, as the rolling analysis model, for example, the Orowan theory disclosed in Non-Patent Document 1 is used to calculate the friction coefficient μ. Furthermore, as a deformation resistance model formula, the Shida's approximate formula also disclosed in Non-Patent Document 1 is used.

In the rolling analysis model, the roll diameter, tension, rolling load, plate thickness, rolling speed, and the like can be measured during rolling and can be treated as known numbers, and thus unknown numbers are the friction coefficient μ and deformation resistance. Therefore, it is possible to calculate the friction coefficient and the deformation resistance as a coupled problem by using two independent values. Therefore, it is possible to obtain the friction coefficient μ by changing the deformation resistance and the friction coefficient so that both the values match and performing the calculation, for example, in a rolling analysis model in which measured values of the rolling load and the forward slip are substituted and a rolling analysis model in which calculated values of the rolling load and the forward slip are substituted.

In the present embodiment, as the rolling analysis model, the Orowan theory and the deformation resistance model formula based on the Shida's approximate formula are used, but the rolling analysis model is not limited to such an example, and the friction coefficient μ may be obtained by use of another rolling analysis model.

In addition, since there is a strong correlation between the friction coefficient μ and the forward slip ($f_S$), an approximate formula for obtaining the friction coefficient μ from the measured forward slip ($f_S$) and rolling load may be created by use of data group representing the relationship between the friction coefficient μ obtained by the above rolling analysis model and the forward slip ($f_S$). For example, the approximate formula for calculating the friction coefficient μ can be expressed as the following formula (2) by use of the forward slip ($f_S$) and the rolling load (p). If necessary, a table may be prepared in accordance with the steel type, plate thickness and rolling temperature.

$$\mu=a\cdot f_S+b\cdot p+c \quad (2)$$

Constants a, b, and c of the approximate formula represented by the formula (2) may be obtained by multiple regression analysis. By using this approximate formula, it is possible to obtain the friction coefficient μ only by using the forward slip ($f_S$) and rolling load (p) actually measured during rolling, and thus a calculation load can be reduced as compared with the method for calculating the friction coefficient μ obtained by substituting the measured values and the calculated values by use of the rolling analysis model.

(Relationship Between Friction Coefficient and Lubricating Oil Supply Amount)

Next, the relationship between the friction coefficient and the lubricating oil supply amount required when the lubrication condition is controlled by changing the lubricating oil supply amount based on the friction coefficient is obtained. In the relationship between the friction coefficient μ and a lubricating oil supply amount Q, generally, when the lubricating oil supply amount increases, the friction coefficient μ tends to decrease significantly at an initial stage at which supply of the lubricating oil is started, and then the change in the friction coefficient μ tends to decrease. From this tendency, the relationship between the friction coefficient μ and the lubricating oil supply amount Q can be expressed by, for example, a third-order approximate formula, that is, the following formula (3).

$$\mu=a\cdot Q^3+b\cdot Q^2+c\cdot Q+d \quad (3)$$

Constants a, b, and c in the approximate formula (3) may be obtained by use of, for example, multiple regression analysis. Note that the lubricating oil supply amount Q refers to a net supply amount of the lubricating oil supplied to a unit surface area of the work rolls or the slab or combination thereof, and does not include a diluent solvent such as mixed water in the case of the emulsion lubricating oil.

In step S100, in the target equipment, the lubricating oil supply amount is changed in the steady state so that the rolling load (p) at each lubricating oil supply amount is acquired by the load cell, and the calculator 122 calculates the forward slip (fs) based on the plate speed ($V_o$) and the work roll speed ($V_R$). The friction coefficient calculator 123 then calculates the friction coefficient at each lubricating oil supply amount from the rolling load and the forward slip using, for example, the above formula (2). When a plurality of relationships between the lubricating oil supply amounts and the friction coefficients is acquired, the relationship between the lubricating oil supply amount and the friction coefficient μ represented by, for example, the above approximate formula (3) is acquired by use of these data. Based on the relationship between the lubricating oil supply amount and the friction coefficient μ acquired in step S100, the lubricating oil supply amount in the in-line mill 100 in actual operation is controlled.

[S102-S116: Lubrication Condition Control in Actual Operation]

The lubricating oil supply amount in the in-line mill 100 in actual operation is controlled based on the relationship between the friction coefficient μ and the lubricating oil supply amount Q acquired in step S100.

First, when the slab is started to be rolled with the in-line mill 100, the load cell 111 arranged in the roll chock of the upper backup roll detects the rolling load (step S102). At this time, the WR speed converter 121 detects the rotation number of the motor 116 that rotates the work rolls 101*a* and 101*b*, and the work roll speed is calculated based on the rotation number of the motor 116, a ratio of the speed reducer, and the work roll diameter (step S104). Furthermore, at this time, the plate speed meter 112 arranged on the outlet side of the in-line mill 100 detects the plate speed of the slab S (step S106). Note that, although FIG. 6 illustrates step S102, step S104, and step S106 in this order, these processes are performed in parallel.

Next, the calculator 122 calculates the forward slip using the work roll speed calculated in step S104 and the plate speed measured in step S106 (step S108). The friction coefficient calculator 123 then calculates the friction coefficient μ based on the detected rolling load and the calculated forward slip (step S110). The friction coefficient μ may be calculated by use of the above formula (2), for example.

Next, the friction coefficient adjuster 124 calculates the lubricating oil supply amount. The friction coefficient adjuster 124 first obtains a difference Δμ between the friction coefficient μ calculated in step S110 and a target friction coefficient $\mu_{aim}$ (step S112). Here, the target friction coefficient $\mu_{aim}$ is set to a value in the range of 0.15 to 0.25. For example, in actual rolling, an error may occur between an actual friction coefficient and the calculated friction coefficient μ due to influence of a control error or a measurement error. The target friction coefficient $\mu_{aim}$ may be set from a range in which the specified range is further narrowed in order to reliably prevent the actual friction coefficient from being outside the specified range of the friction coefficient due to such an error. When the specified range of the friction coefficient is 0.15 or more and 0.25 or less as in the present embodiment, the target friction coefficient $\mu_{aim}$ may be 0.20, for example.

Next, the friction coefficient adjuster 124 calculates an adjustment amount of the lubricating oil corresponding to the difference Δμ calculated in step S112 (hereinafter, also referred to as a "lubricating oil adjustment amount ΔQ") based on the relationship previously acquired in step S100 between the known friction coefficient μ and the lubricating oil supply amount Q (step S114).

For example, when the formula (3) is acquired as the relationship between the friction coefficient μ and the lubricating oil supply amount Q, a change amount of $\Delta\mu_v$ the friction coefficient μ when the lubricating oil supply amount changes by ΔQ from a certain lubricating oil supply amount $Q_0$ is represented by the following formula (4).

$$\Delta\mu_v = d\mu/dQ \cdot \Delta Q = (3a \cdot Q_0^2 + 2b \cdot Q_0 + c)\Delta Q \quad (4)$$

From the above formula (4), a supply amount of the lubricating oil (that is, the lubricating oil supply amount) ΔQ to be adjusted by the difference Δμ calculated in step S112 between the friction coefficient μ and the target friction coefficient $\mu_{aim}$ is calculated.

The friction coefficient adjuster 124 then adjusts the currently set lubricating oil supply amount Q by the lubricating oil adjustment amount ΔQ according to the difference Δμ between the friction coefficient μ and the target friction coefficient $\mu_{aim}$ to change the currently set lubricating oil supply amount Q to a lubricating oil supply amount Q+ΔQ (step S116). The friction coefficient adjuster 124 controls the pump P so that a supply amount of the lubricating oil by the lubricating oil supply nozzles 105*a* and 105*b* is a lubricating oil supply amount $Q_0$+ΔQ. As a result, the friction coefficient μ is the target friction coefficient $\mu_{aim}$.

The processes of steps S102 to S116 are repeatedly performed during rolling of the slab (S118). If the rolling of the slab is completed (step S118/Yes), the control of the lubrication condition in the in-line mill 100 is completed. On the other hand, if the slab is being rolled (step S118/No), the process is started again from step 202 of detecting the rolling load by the load cell, and the processes up to step S116 of adjusting the lubricating oil supply amount are repeatedly performed.

The method for controlling the lubrication condition according to the present embodiment has been described above. In the present embodiment, the lubricating oil supply amount to the work rolls has been described, but the lubrication condition is not limited to the lubricating oil supply amount as long as the friction coefficient μ can be changed. For example, the lubrication condition may be controlled by other methods such as a type of the lubricating oil, a ratio of the lubricating oil and water in the emulsion lubricating oil, and the supply temperature of the lubricating oil.

For example, the lubricating oil in the present embodiment may be based on a synthetic ester or a mixture of the synthetic ester and vegetable oil. Moreover, a solid lubricant or an extreme pressure additive may be added as necessary. Note that, when a pour point of the lubricating oil is 0° C. or higher, the lubricating oil solidifies in the winter, and thus the pour point of the lubricating oil is preferably lower than 0° C.

EXAMPLES

In order to confirm the effect of the present invention, by use of an equipment similar to the continuous casting equipment 1 according to the present embodiment illustrated in FIG. 2, the presence or absence or the like of occurrence of folding of a protrusion of a slab formed by dimples was investigated. In each of an example and a comparative example, a slab having protrusions each having a width of 2 mm in the rolling direction and a height of 130 μm was used.

The present example was performed in manufacturing steps of a slab having a configuration similar to that in FIG. 2. In the present example, ordinary steel having a plate thickness of 2 mm and a plate width of 1200 mm was used. An acceleration rate of the cooling drum from the start of casting was 150 m/min/30 seconds, and a rotation speed of the cooling drum in the steady state was 150 m/min. Note that an initial profile of the cooling drum was processed so that a plate crown of the slab was 43 μm in the steady state. Note that the rolling of the slab in the present example was performed on the ordinary steel, but a type of steel rolled is not limited to the ordinary steel.

Furthermore, in the in-line mill, one-pass rolling was performed on the slab with a plate temperature of 1000° C. at a rolling reduction of 30%, and the slab on the outlet side of the in-line mill had a plate thickness of 1.4 mm. The rolling with the in-line mill was started after a dummy sheet passed through the in-line mill and the plate crown of the slab became 150 μm or less. In the present verification, the rolling with the in-line mill was started 15 seconds after the start of casting. As rolling lubricating oil, lubricating oil (melting point: 0° C.) based on a synthetic ester (hindered complex ester) was supplied by an air atomizing method.

In the present example, the rolling load (p) and the forward slip (fs) during rolling was measured to obtain the friction coefficient μ by use of the above formula (2). In the present embodiment, based on the friction coefficient μ obtained by the above formula (2) and the relationship represented by the above formula (3) between the friction coefficient μ and the lubricating oil supply amount Q, the lubricating oil adjustment amount ΔQ is calculated from the above formula (4), the lubricating oil supply amount was controlled while the target friction coefficient $\mu_{aim}$ was set to 0.21, and the lubricating oil supply amount was controlled. As a result, the slab was rolled so that the friction coefficient μ was in the range of 0.19 to 0.23. The rolled slab was pickled in a pickling step, and then multi-pass rolling was performed to obtain the slab having a plate thickness of 0.2 mm with a Sendzimir rolling mill having a diameter of 60 mm. In the pickling step, scarfing was performed at 10 μm.

On the other hand, in the comparative example, rolling was performed similarly to the example without supplying the lubricating oil, pickling was performed in the pickling step, and then rolling was performed similarly to the example. The friction coefficient μ at this time was calculated to be 0.38 by use of the Orowan theory and the deformation resistance model formula based on the Shida's approximate formula as the rolling analysis model. Furthermore, in the pickling step, scarfing was performed at 10 μm.

Rolling was performed for 50 coils in total for the example and the comparative example, and a surface of the slab after the rolling by the Sendzimir rolling mill was observed. As a result of observing the surface, in the example, no surface defect was confirmed in the slab. On the other hand, in the comparative example, surface defects were confirmed in the slab. When similar rolling was performed again under the conditions of the comparative example, it was confirmed that scarfing at 30 μm was necessary in the pickling step in order to eliminate the surface defects. That is, it was confirmed that, in the comparative example, it was necessary to perform scarfing on the slab three times as much as that in the example. From these results, it was found that, by appropriately controlling the range of the friction coefficient μ when the slab is rolled, it is possible to prevent the occurrence of folding of a protrusion, and to improve pickling efficiency by three times compared to the conventional technology.

From the above description, it has been confirmed that, when a slab is manufactured with a twin-drum type continuous casting equipment, it is possible to prevent folding of a protrusion on a surface of the slab during rolling, improve the pickling efficiency, and prevent surface defects that would appear in rolling at the next step, thereby reducing a manufacturing cost.

Although the preferred embodiment of the present invention has been described in detail with reference to the accompanying drawings, the present invention is not limited to this example. It is apparent that a person having ordinary skill in the art to which the present invention pertains can conceive various changes or modifications within the scope of the technical idea described in the claims. It is understood that these changes and modifications also belong to the technical scope of the present invention.

FIELD OF INDUSTRIAL APPLICATION

According to the present invention, it is possible to provide a manufacturing method for a slab and a continuous casting equipment capable of preventing, without impairing productivity, folding of a protrusion that occurs when a slab having protrusions formed by a twin-drum type continuous casting apparatus is rolled with an in-line mill.

BRIEF DESCRIPTION OF THE REFERENCE SYMBOLS

1 Continuous casting equipment
10 Twin-drum type continuous casting apparatus
10*a*, 10*b* Cooling drum
15 Molten metal storage portion
20 Oxidation prevention apparatus
30 Cooling apparatus
40 First pinch roll apparatus
40*a*, 40*b* Pinch roll
41 Position detection apparatus
60 Second pinch roll apparatus
70 Coiling apparatus
88*a*, 88*b* Tension roll
100 In-line mill
101*a*, 101*b* Work roll
102*a*, 102*b* Backup roll
103*a*, 103*b*, 104*a*, 104*b* Cooling water supply nozzle
105*a*, 105*b* Lubricating oil supply nozzle
106*a*, 106*b*, 107*a*, 107*b* Draining plate
110 Measurement apparatus
111 Load cell
112 Plate speed meter
115 Lubricating oil tank
116 Motor
120 Lubrication control apparatus
121 WR speed converter
122 Calculator
123 Friction coefficient calculator
124 Friction coefficient adjuster

What is claimed is:

1. A manufacturing method for a slab by a continuous casting equipment comprising:

a twin-drum continuous casting apparatus in which a pair of cooling drums having dimples formed on surfaces of the cooling drums and a pair of side weirs form a molten metal storage portion, and that casts a slab having protrusions formed by the dimples from molten metal stored in the molten metal storage portion while the pair of cooling drums are rotated;

a cooling apparatus that is arranged on a downstream side of the twin-drum continuous casting apparatus and cools the slab;

an in-line mill that is arranged on a downstream side of the cooling apparatus and performs one-pass rolling on the slab with a work roll at a rolling reduction of 10% or larger; and a coiling apparatus that is arranged on a downstream side of the in-line mill and coils the slab into a coil, the manufacturing method comprising:

calculating a friction coefficient from measured values of a rolling load and a forward slip when the slab is rolled using a rolling analysis model, the rolling analysis model using an Orowan theory and a deformation resistance model formula based on a Shida's approximate formula;

calculating a difference between the friction coefficient that was calculated and a target friction coefficient having a value within a predetermined range, the predetermined range being 0.15 or more and 0.25 or less;

calculating an adjustment amount of a lubrication condition corresponding to the difference that was calculated between the friction coefficient and the target friction coefficient; and controlling the lubrication condition during rolling of the slab based on the adjustment amount that was calculated.

2. The manufacturing method for a slab according to claim 1, wherein a height of each of the protrusions is 50 μm or higher and 100 μm or lower.

3. The manufacturing method for a slab according to claim 2, wherein the lubrication condition is a supply amount of lubricating oil supplied to the work roll or the cast slab or combination thereof.

4. The manufacturing method for a slab according to claim 1, wherein the lubrication condition is a supply amount of lubricating oil supplied to the work roll or the cast slab or combination thereof.

5. A continuous casting equipment comprising:

a twin-drum continuous casting apparatus in which a pair of cooling drums having dimples formed on surfaces of the cooling drums and a pair of side weirs form a molten metal storage portion, and that casts a slab having protrusions formed by the dimples from molten metal stored in the molten metal storage portion while the pair of cooling drums are rotated;

a cooling apparatus that is arranged on a downstream side of the twin-drum continuous casting apparatus and cools the slab;

an in-line mill that is arranged on a downstream side of the cooling apparatus and performs one-pass rolling on the slab with a work roll at a rolling reduction of 10% or larger;

a coiling apparatus that is arranged on a downstream side of the in-line mill and coils the slab into a coil;

a measurement apparatus that actually measures a rolling load and a forward slip of the slab rolled with the in-line mill; and a lubrication control apparatus configured to:

calculate a friction coefficient from measured values of the rolling load and the forward slip using a rolling analysis model, the rolling analysis model using an Orowan theory and a deformation resistance model formula based on a Shida's approximate formula, calculate a difference between the friction coefficient that was calculated and a target friction coefficient having a value within a predetermined range, the predetermined range being 0.15 or more and 0.25 or less;

calculate an adjustment amount of a lubrication condition corresponding to the difference that was calculated between the friction coefficient and the target friction coefficient; and control the lubrication condition during rolling of the slab based on the adjustment amount that was calculated.

6. The continuous casting equipment according to claim 5, wherein a height of each of the protrusions is 50 μm or higher and 100 μm or lower.

7. The continuous casting equipment according to claim 6, wherein the lubrication control apparatus includes a friction coefficient adjuster that calculates a supply amount of lubricating oil required to control the friction coefficient and controls supply of the lubricating oil supplied to the in-line mill.

8. The continuous casting equipment according to claim 5, wherein the lubrication control apparatus includes a friction coefficient adjuster that calculates a supply amount of lubricating oil required to control the friction coefficient and controls supply of the lubricating oil supplied to the in-line mill.

* * * * *